US006992253B1

(12) United States Patent
Spellman et al.

(10) Patent No.: US 6,992,253 B1
(45) Date of Patent: Jan. 31, 2006

(54) STRENGTH STRAND CONSTRUCTION FOR A LONGITUDINAL SECTION OF A CABLE

(75) Inventors: Charles D. Spellman, Rocky Hill, CT (US); Walter J. Roderick, Mystic, CT (US); Donald C. Portofee, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 43 days.

(21) Appl. No.: 10/631,222

(22) Filed: Jul. 30, 2003

(51) Int. Cl.
*H01B 7/00* (2006.01)
*H01B 7/34* (2006.01)

(52) U.S. Cl. ..... 174/74 R; 174/75 F; 174/78

(58) Field of Classification Search ..... 174/75 F, 174/28, 20, 74 R, 75 C, 78, 79, 84 R, 88 C, 174/89
See application file for complete search history.

(56) References Cited

U.S. PATENT DOCUMENTS 1,670,543 A * 5/1928 Kellems ..... 403/291
3,672,006 A * 6/1972 Fidrych ..... 24/122.6
4,116,153 A * 9/1978 Fisher et al. ..... 114/244
4,368,910 A * 1/1983 Fidrych ..... 294/86.42
4,509,877 A * 4/1985 Sobin et al. ..... 403/41

* cited by examiner

*Primary Examiner*—William H. Mayo, III
(74) *Attorney, Agent, or Firm*—James M. Kasischke; Jean-Paul A. Nasser; Michael P. Stanley

(57) ABSTRACT

An assembly including a span of microwave signals flexible coaxial line, or other form energy transmission media, is provided with generally coextensive, non-metallic longitudinal strength strands to render greater tensile strength to the assembly. Marginal axial end sections of a coaxial cable span are potted in respective polyurethane grip foundation having longitudinal grooves. The grip foundations are inserted into an open-mesh-sleeve type cable-end grip device. The strength strands are seated in the grooves and interlaced in and out of the openings in the open-mesh-sleeves of the grip devices. Co-adjacent marginal end portions of the strength strands are bundled beyond the interlacing, and knotted to the open-mesh-sleeves of the grip devices. In forming the knots the bundled marginal end portions of the strength strands are entwined and bound together and with a pair of the crossing strands of the open-mesh-sleeve.

15 Claims, 3 Drawing Sheets

STRENGTH STRAND CONSTRUCTION FOR A LONGITUDINAL SECTION OF A CABLE

CROSS REFERENCE TO RELATED PATENT APPLICATION

This application is related to a co-patent application entitled OUTER CASING STRUCTURE AND FABRICATION METHOD FOR CABLE SECTIONS AND NAVY BUOYANT ANTENNAS, filed on an even date herewith. This co-pending application is hereby incorporated herein in its entirety.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The present invention relates to a novel apparatus and method for providing tensile strength to longitudinal sections of cables, including cables in which a linear energy transmission medium has a surrounding arrangement of a damage resistant outer sheath with emollient liquid between the sheath and the transmission medium. It also relates to such providing tensile strength to forms of cable section assemblies having a layer of flexible molded material between the damage resistant sheath and the central core structure containing the transmission medium. An example of the latter type of cable section assembly is disclosed in U.S. Pat. No. 6,426,464, issued 30 Jul. 2002, and especially therein in a discussion of a best mode of that invention for applications of that invention in which the cable section assemblies are used in environments in which they are extremely stressed (especially see the description therein at column 12, line 65 through column 18, line 4). This U.S. Pat. No. 6,426,464 is hereby incorporated herein in its entirety. An aspect of the invention is also of special utility in providing tensile strength to cable section assemblies for microwave coaxial lines.

(2) Description of the Prior Art

Submarines must be able to send and receive messages. Radio reception from a submerged submarine is maintained through a buoyant cable antenna ("BCA") which comprises an antenna line train of components including at least at the trailing end thereof a detachably connected longitudinal sectional component. The BCA rises above the submarine and floats and streams at or near the ocean surface. When not in use, the BCA is coiled around a small diameter spool in the submarine, requiring considerable flexibility. When deployed from the submarine, the BCA and its components require a demanding structure due to the substantial stress placed on the BCA. For example, the BCA is subjected to severe mechanical shocks when towed in high sea conditions, e.g., the BCA must rise from various depths and may be subjected to waves of up to 35 feet at the ocean surface. Thus, tensile strength is critical to the BCA structure.

Prior art BCA cable section assemblies elements are known wherein the tensile strength was augmented by the provision at their respective ends of cable-end grips of the type affixing to core structures of the assembly by open-mesh-sleeves which tightened their constriction on the core structure by Chinese-finger-toy like tightening of the mesh sleeve around a grip foundation sleeve molded on the core structure. Also a prior attempt was made to increase the tensile strength and flexing damage resistance characteristics of BCA cable section assemblies was by potting the length of core structure in cured flexible polyurethane, which is moldingly bonded to the grip foundation gripped by the open-mesh-sleeves of the cable-end gripping device. However, the prior attempt using this approach did not provide a significantly improvement over the tensile strength and flexing damage avoidance capabilities provided by the grip sleeves and grip foundation alone.

Accordingly, there is an unsatisfied need for a cable section assembly of a BCA having an imbedded coaxial cable which has higher tensile strength and flexing damage resistance characteristics than heretofore available by application of the foregoing known prior art, and attempted approach of of improvement, of insertion of a moldingly bonded grip foundation into an open-mesh-sleeve type cable end grip.

There are additional prior art devices relating to various types of cable assemblies or reinforcing members which do not involve gripping by open-mesh-sleeves such as disclosed in U.S. Pat. Nos. 2,352,391; 4,463,358; 4,491,939; 4,749,420 and 5,057,092. Thus, for example, U.S. Pat. Nos. 4,463,358 and 4,749,420 generally disclose basic buoyant cable antennas. Additionally, U.S. Pat. Nos. 2,352,391, 5,057,093 and 4,634,804 generally disclose the use of spaced elongated strengthening members. U.S. Pat. No. 4,491,939 generally discloses a cable using a Kevlar® member.

SUMMARY OF THE INVENTION

It is a primary object of the invention to provide an apparatus and method which provides higher tensile strength characteristics than have heretofore been available in prior art forms of structure of buoyant cable antenna (BCA) cable section asseblies.

It is a further primary object of the invention to provide an apparatus and method for providing high tensile strength characteristics to a BCA cable section assembly which contains a span of coaxial cable, one or more wire conductors, wire cable, a fiber optic cable, other forms of linearly extending energy transmission media, or electronic components serially distributed along it length which are interleaved between shorter spans of the coaxial cable.

It is another object of the invention to provide an apparatus and method for providing tensile strength to a BCA cable section assembly in a way which enables the component to be readily designed to be of a selected length, which in turn enables designing high tensile strength BCA cable section assemblies to selectively match the length of an existing tubular jackets for BCA's.

The invention is directed to strengthening an assembly which includes a span of coaxial cable or other forms of energy transmissive media, and which in one illustrative embodiment is employed as buoyant antenna cable (BCA) cable section assembly. In accordance with the invention, multiple longitudinal non-metallic high tensile strength strands, which are integrated into the span assembly by a specific construction and arrangement, provide increased tensile strength to the span assembly. The preferred material for the longitudinal strengthening strands is Kevlar®, an aromatic polyamide fiber manufactured and sold by E.I. DuPont de Nemours Company, which exhibits a high breaking strength in the longitudinal direction. Specifically, axially extending marginal end portions of the span of coaxial cable are placed into a conventional two-part cable encasement producing mold, into which is introduced a polyurethane forming polymer composition which is cured at room temperature to form a grip foundation molded and bonded to the cable around the marginal end portion. In individual molding processes such grip foundation are formed at each end of the span.

Each grip foundation has formed in its outer surface a set of at least three longitudinal grooves. Upon curing and removal from the mold, pairs of open-mesh-sleeve type cable-end grips, are slid over the axial end sections of the cable potted in the polymer grip casing. A corresponding set of at least three longitudinal Kevlar strands of the same length as the cable span are laid next to the cable spans and have their end portions interlaced in and out of adjacent openings in the open-mesh-sleeve of the cable-end grip device a significant number of times, each strand being interlaced along a respective groove in the grip foundations. The grooves in the grip foundation provide room for the Kevlar strands to be pass there through in the course of being interlaced through the mesh. The strands at each end of the set are gathered and tied to an intersection of mesh strands of the sleeve by a self-seizing knot at a position near the axially outer end of the open-mesh-sleeve. The tail ends of the strands beyond the knot are trimmed and tucked under the mesh and secured in place, e.g., by epoxy glue, in order that the ends do not protrude from the cylindrical envelope dimension of the cable section assembly.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
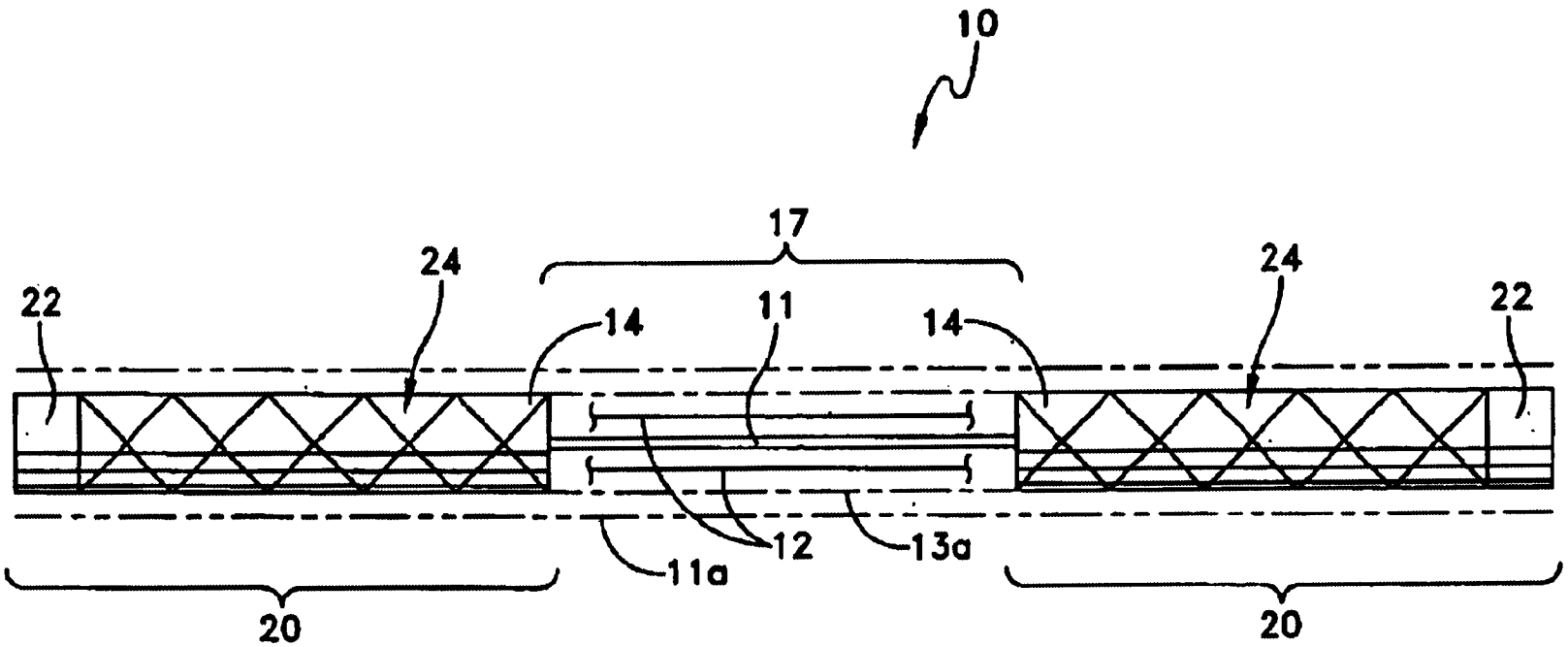
FIG. 1 is a mechanical schematic, depicted in the fashion of a side elevation, of a microwave coaxial line cable section assembly representative of apparatus in accordance with the invention (only the portion of the span of strength strands being shown for clarity)
Figure 2:
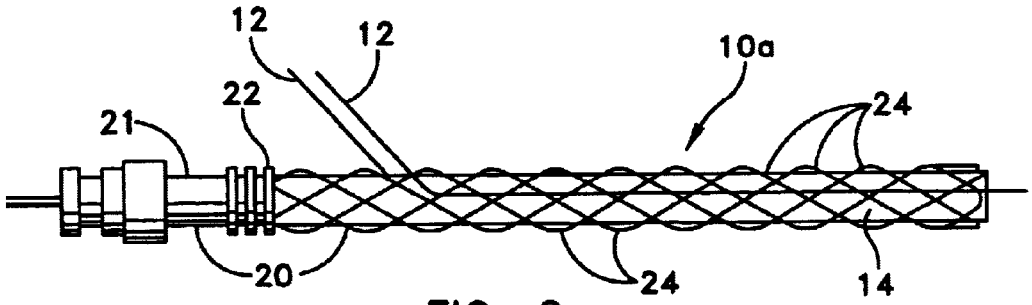
FIG. 2 is a side elevation of one end of an interim manufacturing step subassembly of the cable section assembly of FIG. 1 (the other end being bilaterally symmetrical thereto) at a stage of fabrication before the ends of the strength strands are knotted, with details of grooves and interweaving of strength strands and mesh being omitted for clarity.
Figure 3:
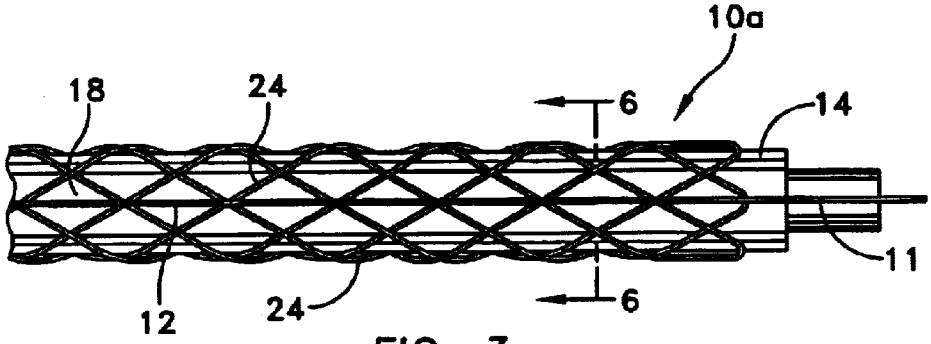
FIG. 3 is an enlarged view of a portion of FIG. 2 showing the interlacing of strength strands and the open-mesh-sleeve and showing presence of a groove in the grip foundation underlying the mesh.
Figure 4:
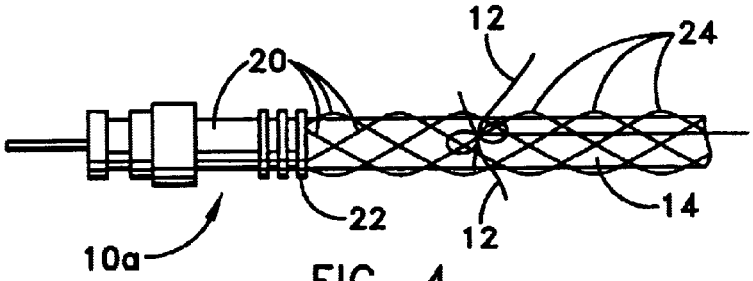
FIG. 4 is a view like FIG. 2, but at a stage of fabrication of the interim manufacturing step subassembly in which the marginal end portions of the strength strands are bundle together and the excess lengths of the strands are trimmed, with the details of longitudinal grooves on the grip foundation, and the details of the knot binding the bundle of marginal end portions of the strength strands with the mesh strands of an open-mesh-sleeve omitted for clarity.

Reference is now made to the drawings and more particularly to FIGS. 1–4 which depict an illustrative embodiment of the apparatus of the present invention. Referring now more particularly to FIG. 1, this apparatus is a microwave coaxial line cable section assembly 10, which includes the microwave coaxial line 11, sheath 11*a* (shown by phantom lines) which is for protection against damage to line 11 and for containing an emollient liquid 11*b* (that serves as a damping medium reduces the magnitude of concussion shock to the assemble which transmitted to line 11). FIGS. 2–4 are directed to an interim manufacturing step subassembly 10*a* of cable section assembly 10. An application of the embodiment of FIGS. 1–4 involving vulnerability to damage by small diameter capstan mechanisms and by potential high magnitude of shock in heavy sea states is disclosed in the hereinabove identified and incorporated by reference U.S. Pat. No. 6,426,464. Therein cable section assembly may be used as a component of the r.f. lead-in and tow cable section (designated 108*a*, FIG. 2, therein) of a buoyant cable antenna (BCA) line (designated 104 therein) towed behind a submarine. It is to be understood that the concepts and teachings of the present invention also have applicability to embodiments like that shown in the hereinabove identifies copending application "Outer Casing Structure and Fabrication Method for Cable Sections and Navy Buoyant Antennas" wherein the annular space between an outer casing (designated 14 therein) an a energy transmission central core structure (designated as a conduit 20 and runs of elective wires 22 therein) is filled with a molded plastic element (designated 24 therein). The concepts and teachings of the present invention further have applicability to embodiments having molded plastic elements between the outer sheath and a central energy transmission structure wherein the central structure houses plastic encapsulated circuit boards, such as the embodiments disclosed in the hereinabove identified U.S. Patent Application No. 6,426,464 wherein the annular space between the outer sheath (designated 40 therein) and the protective tube (designated 14 therein) containing runs of electronic hook-up media (designated 12 therein) and between the sheath and the electronic circuit boards (designated 18 therein) contains plastic molded parts (designated 16 and 20 therein). (The application of this invention to the latter embodiment disclosed in U.S. Pat. No. 6,426,464 will be discussed of drawings later herein.) A typical length of a BCA longitudinal sectional component of a BCA line is of the order of ten feet. In operational use a BCA sectional component can be exposed to enormous tensile and flexional strains and stresses with considerable shock or concussion effects. For example, The sea surface whereat the BCA sectional component floats and streams at the speed of the towing submarine may can attain sea states having 35 foot wave.

Cable span assembly 10 serves a two-fold function namely (i) provision of the mechanical structural support needed to withstand the aforesaid stresses and (ii) provision of the instrumentalities for mechanical and electrical connection with an adjoining portion.

It is to be understood that as one of the last steps of manufacture of a BCA longitudinal sectional component, the cable span assembly 10 is fitted into a suitable jacket 11*a* (shown by phanton lines) which serve to: (i) protect cable span assembly 10 from abrasion, (ii) seal off cable span assembly 10 from seawater, and (iii) where buoyancy is desired provide a housing which forms space to contain buoyant material.

Figure 5:
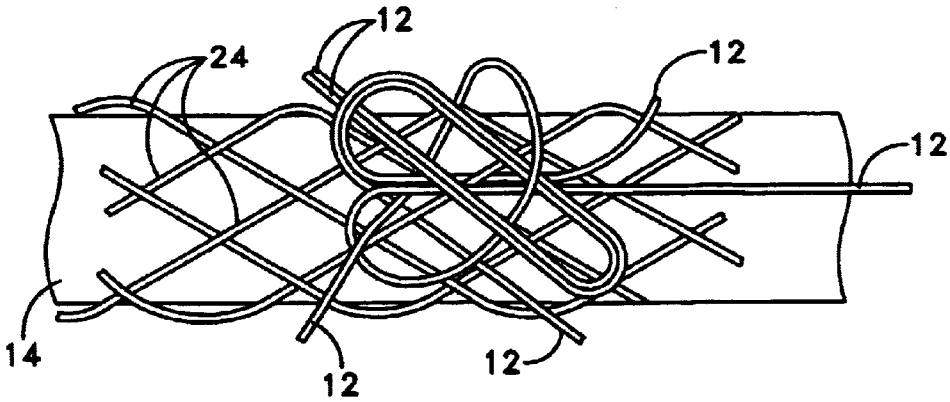
FIG. 5 is a diagrammatic view representing an enlargement of FIG. 4, which illustrates a suitable self-seizing knot for binding the strands and two individual strands of an open-mesh-sleeve.

In accordance with the present invention a set of at least three high tensile strength and high breaking point strength strands 12 (which FIGS. 1–3 and 6 show without the complication of knotting; and which FIGS. 4 and 5 show including the knotting) provide cable section assembly 10 with the tensile strength and resistance to damage by flexing needed to withstand the above discussed large scale stresses and strains. The mechanical construction and arrangement by which strength strands 12 provide this tensile strength and resistance to flexure damage will be understood as this description proceeds.

It is to be understood that although the foregoing illustrative embodiment discloses microwave coaxial cable as the object of the mechanical structure support by cable section assembly 10, the concept of the present invention also extends to use of the assembly as such support linearly extending energy transmission medium generally including conductor wires, wire cables, and fiber optic cables.

A preferred material to be employed as the high tensile strength, high breaking point set of strands 12 is an aromatic polyamide fiber widely commercial available and often identified by tradename Kelvar® of E.I. DuPont de Nemours Company. Kevlar® is the preferred material because it exhibits a high breaking strength in the longitudinal direction. Other aromatic polyamide fibers having tensile strength characteristics similar to Kevlar® may also be used in accordance with the invention.

Figure 6:
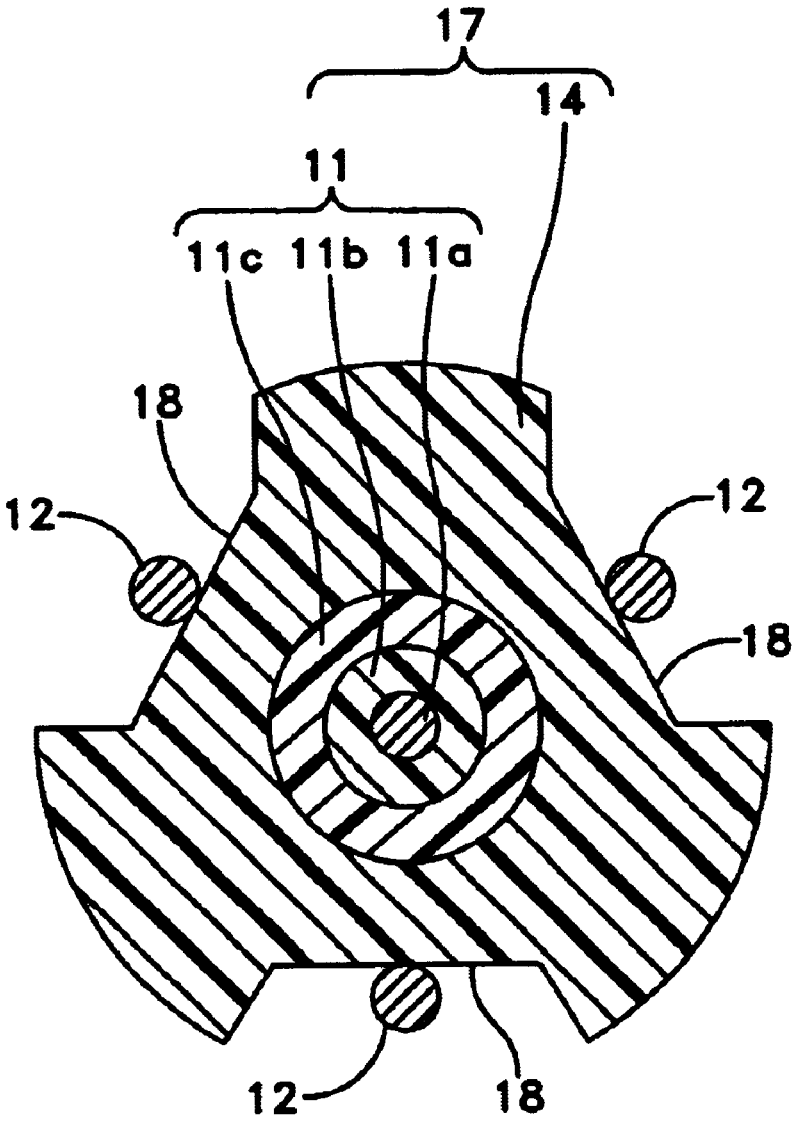
FIG. 6 is a section taken along section line 6—6, FIG. 3, but with the mesh omitted for clarity.

Referring now collectively to FIGS. 1, 2, 3 and 6, in the construction of span assembly 10, an axially extending grip foundation 14 is molded and bonded to coaxial cable 11. It is to be understood that a minor image of the constructions of FIGS. 2, 3 and 4 are present at the opposite side of assembly 10. Illustrative of cable 11 is the RG-178, flexible coaxial cable for transmitting microwave signals manufactured by Times Microwave Systems. Referring to FIG. 6 cable 11 includes a moldingly bonded concentric arrangement of an central linear member 11*a*, an intermediate layer portion 11*b*, and an outer layer 11*c* at least the latter of which has an affinity for moldingly bonding with thermo-setting molding compounds. The process of molding and bonding grip foundation 14 to cable line 11 may employ a 2-*part* mold adapted to receive a span of the cable and to mold a grip foundation encasement around an axial section thereof. At each of the opposite end of cable line 11 an axially extending section of the line proximate to the respective ends of the line is placed in the mold, and the mold is filled with a thermo-setting polymer composition which is curable at room temperature. Stated another way, the selected axial section of the coaxial cable is potted in the polyurethane polymer grip foundation 14. A preferred polymer is TC-512, a polyurethane curing polymer composition manufactured and sold by BJB Enterprises of Garden Grove, Calif. When the polyurethane is cured, the coaxial cable line, or other form of transmission media 11 and the grip foundation 14 will have formed an integrably molded cable and grip foundation subassembly 17, FIG. 6, which has a length co-extensive with the open-mesh-sleeve of a cable-end grip device (cable-end-grip device assembly 20 and its component mesh-sleeve 24 shown in FIGS. 1,2 and 4 will be introduced and discussed in detail later herein). Subassembly 17 is then removed from the mold. Other thermo-setting polymers which may be employed include polysulfides and RTV silicones. In a preferred embodiment, grip foundation 14 has formed therein a set of at least three longitudinal grooves 18 (best shown in FIG. 6) of a number corresponding to the number of strength strands in strength strands set 12. For the embodiment of a cable section assembly 10 containing microwave coaxial cable line wherein the outside diameter, and of an outside diameter of 0.65 inches this the number of grooves 18 on grip foundation 14 is three (3). However, additional grooves may be utilized to enable utilizing additional strength strands 12 and increasing the tensile strength of cable span assembly 10. Grooves 18 are preferably formed in the course of molding. In planes perpendicular to the axis of the coaxial cable line 11, groove 18 are equiangularly radially spaced and the grooves in the grip foundation at opposite ends of interim manufacturing step subassembly 10*a* are in angular registry with one another about the cable axis. The grooves are of a depth to provide recessed spaces to receive the longitudinal strength strands 12. This is best seen in the cross-section of subassembly 17 in FIG. 6.

At each end of subassembly 10*a* there is a cable-end grip device assembly 20, which comprises (i) an axially outwardly 8 disposed mechanical and electrical coupling subassembly 22, and (ii) an axially inwardly disposed open-mesh-sleeve 24. The aspect of subassembly 22's mechanical attachment to coaxial cable line 11, and the aspect of electrical coupling performed by subassembly 22 are conventional and form no part of the invention. The open-mesh-sleeve component 24 of grip device assembly is also conventional. However, as will become apparent as this description proceeds its structure and the structural relationship between it and other elements of interim manufacturing step subassembly 10*a* is an important aspect of the present invention. In attaching each grip assembly 20 at the ends of subassembly 10*a*, the open-mesh-sleeve component 22 is slid over and receives the outer surface (sometimes hereinafter and in the appended claims called the "grip foundation surface") 14 within cylindrical interior of the mesh with a fit that any sliding motion in the direction of withdrawing the grip foundation 14 causes considerable sliding friction. Such sliding friction in turn causes the "Chinese-finger-toy" phenomenon of causing radial constriction of the open-mesh-sleeve, in turn increasing the gripping force which assembly 20 exerts on grip foundation 14.

As best shown in FIG. 3 open-mesh-sleeve 24 is of the conventional type in which first and second pluralities of mesh forming strands are helically wound in opposite helical directions of winding in a construction known as a braided open-mesh-sleeve (i.e., the mesh strands alternatingly pass above and below successive mesh strands wound in the opposite direction). Note that in the embodiment of FIG. 3 the number of strands in each of the first and second pluralities of strands wound in respective opposite directions of helical winding is three (3).

As mentioned earlier herein, high tensile strength and high breaking point strength strands 12 augment the tensile strength and flexure damage resistance characteristics of interim manufacturing step subassembly 10*a*. As particularly shown in FIG. 6 in conjunction with FIGS. 2 and 3, the number of strands of the set, which corresponds to the number of axially extending grooves 18 in grip foundations 14 are laid along the respective grooves 18 at each end of assembly 10. In the embodiment of FIGS. 2–4 there are three strands to a set. The spans of the individual strands extend between the grip foundation 14 generally coextensively with the total length of coaxial cable line 11. The end portions of the strands 12 include enough excess strand material to permit getting a purchase hold on the strand for purposes of the processes of knotting and making the strands taut, to be described later. Proximate to each end of each strength strand 12 is an axially extending portion that lies next to a groove 18 in the grip foundation 14. Except for knotting at its axially out end, this portion of each strand is interlaced in and out of successive openings in the associated open-mesh-sleeve. As best shown in FIG. 3 the interlacing taking place where mesh strands being wound in opposite helical directions cross. The grooves 18 provide enough space underneath the open-mesh-sleeves 24 to accommodate the interlacing.

Referring now to FIGS. 2 and 4, as mentioned the interlacing of strength strands in and out of mesh sleeve 24's openings terminates short of the axially outwardly end of mesh sleeve 24 to enable the knotting and strength strand tensioning processes hereinafter described. In an illustrative embodiment of a cable section assembly 10 for the aforesaid RG-178 coaxial cable line interlacing is terminated approximately two inches from the axially outer end of open-mesh-sleeve 24, and the strength strands are interlaced in and out of twelve openings in the mesh sleeve, i.e., six cycles of interlacing took place.

At each end of a subassembly 10*a* the outer ends of the strands beyond termination of the interlacing are gathered and together knotted into a modified Diamond form self seizing knot 25, FIG. 5, at a location in the open-mesh-sleeve where two mesh strands winding in opposite directions of helical winding cross. It is to be appreciated that the modified Diamond self-seizing knot 25 conjointly binds together the strands of set 12, and two mesh strands respectively winding in opposite direction of helical winding. As an alternative to the modified Diamond knot, any of a number of other of known self-seizing process knotting process which can effect such conjunctive binding of strands. Using any suitable jig arrangement, or manually by two or more craftsmen working as a team, the coextensive spans of coaxial line 11 and the sets of strength strands are simultaneously drawn into taut conditions during the knotting process. Note that the ends of coaxial cable line 11 are made fast to the grip devices at opposite ends of cable section assembly 10 by action of the open-mesh-sleeve upon the grip foundation. The excess lengths of strength strands 12 are then trimmed, tucked under a nearby strand of open-mesh-sleeve 24, and secured in place, such as by epoxy glue. This is done in order that they do not protrude from subassembly 10*a*'s dimensional envelope requirements for fitting in sheath 13.

After intermediate manufacturing step subassembly 10*a* is fabricated, the completion of assembly of cable section assembly 10 is performed. Subassembly 10*a* is fitted within sheath boa (phantom lines, FIG. 1), using any of a number of known techniques and jig arrangements. A sealing relationship between the marginal end portions of sheath 13 and the axially outwardly disposed mechanical and electrical coupling subassemblies 22, FIG. 1 of the cable-end grip devices 20 established is performed to seal against seawater entering the sheath, or to otherwise satisfy other requirements for hermetic sealing. This is done using any of a number of known constructions and techniques. Finally, the generally annularly cross-sectioned space along the length of the span of coaxial line 11 is filled with any suitably emollient liquid, and the penetrations made in the sheath in the performance of the filling are sealed.

At the time the ends of the sets of strength strands 12 were knotted to the open-mesh-sleeves 24, the generally co-extensive spans of the strength strands 12 and the coaxial cable line 11 were simultaneously in taut conditions. The self-siezing modified Diamond knots make fast the ends of the set of strands 12, to the grip devices 20 at opposite end of assembly 10, FIG. 1. As noted the ends of cable line 11 are also made fast to the grip devices by action of open-mesh-sleeves 24 upon grip foundations 14. Therefore, in cable section assembly 30, FIG. 1, the two gripping devices 20 upon tying knots 25 the assembly's opposite ends are constrained to a predetermined maximum distance of separation determined by the length of the spans of cable line 11 and the length of span of strands 12 between. This is fixed regardless of the tension across assembly 10 or forces of flexing upon assembly 10. Further, because axial sections of the strength strand laying adjacent to grooves 18 in grip foundations 14 are interlaced through openings in the open-mesh-sleeve 24, an increase in tensions across all the strands together, or across only one or tow of the strands (in the case of flexing) will cause open-mesh-sleeve 24 to constrict in the manner of a Chinese-finger-toy, increasing the gripping actions that make fast the ends of coaxial cable line 11 to the cable end gripping devices 20. This combination of effects of the strength strand construction and arrangement in accordance with the present invention provide a capability of cable section assembly 10 to cope with large surges in tensile stress, and a capability to cope with effects of repeated flexing during reeling of the cable section on small diametered reels.

The invention has been above described in connection with an embodiment of BCA longitudinal sectional component shown in FIG. 1 having a continuous coaxial cable extending between the grip assemblies 20 at the ends of the sectional component, with the void space between the jacket 11*a* and the cable span core assembly 10 filled with emollient liquid.

However, it is to be understood that the concept of the invention extends to other embodiment of BCA sectional components wherein the spaces between the jacket and a cable span core assembly contain glass microballoon filled polyurethane buoyant material (not shown herein), and the core assembly comprises a pluarality of sections of coaxial cable (not shown herein) having interleaved therebetween electronic component units (not shown herein). The microballoon filled polyurethane material is relatively soft. A preferred microballoon filled polyurethane material to occupy the spaces between the jacket and the cable span core assembly is disclosed in said U.S. Pat. No. 5,606,329. Each of the electronic component units comprises an electronic circuit board (not shown herein) embedded on a polyurethane encapsulate (not shown herein) which is harder than the buoyant polyurethane material. An example of this type of encapsulant for of BCA sectional component is disclosed in the hereinabove identified and incorporated by reference U.S. Pat. No. 6,426,424. The above mentioned described (i) buoyant, filled polyurethane material (designated 16 therein), (ii) sections of coaxial cable (designated 12*a*, 12*b*, etc. therein), (iii) electronic circuit boards (designated 18*a*, 18*b*, etc. therein), and (iv) harder polyurethane encapsulate (designated 20*a*, 20*b* therein) may be seen in FIGS. 3, 4 and 4*a* of U.S. Pat. No. 6,426,464, respectively. A further structural feature which can be seen in FIG. 4 of U.S. Pat. No. 6,426,464 is that the plural sections of coaxial cable are each encased in a flexible tubular conduit (designated 14 therein), which at each of its ends is moldingly bonded with the harder polyurethane encapsulate (designated 120, therein) of the adjacent electronic component unit or with an adjacent grip foundation (not shown in U.S. Pat. No. 6,426,464) which is also of such harder polyurethane material.

The following described modifications to the structure disclosed in U.S. Pat. No. 6,426,464 constitutes the best mode which the inventors contemplate in connection with a BCA longitudinal sectional component in which void spaces between the jacket and the cable span assembly are occupied with a soft, buoyant microballoon containing polyurethane type material instead of the emollient liquid. Three or more strength strands as described hereinabove in connection with the embodiment of FIG. 1 of the present invention, extend between the grip assemblies at the ends of the sectional component. However, instead of extending in the void space between the grip foundations they pass through flexible tubular conduits encasing the coaxial cable sections, and pass through and are moldingly embedded in a harder polyurethane encapsulate of the electronic component units interleaved between coaxial cable sections. In this best mode, the substrate upon which each grip foundation is molded as an extension of the outermost of these tubular conduits at the opposite ends of cable span assembly designated 110 therein. The strands are located in sectors of a transverse reference plane through the encapsulate where they will not interfere with the circuit board which is also embedded in each electronic component unit. In the tubular conduits adjacent to the grip subassemblies (designated 17 therein) at the ends of the sectional component, and more particularly at axial locations in these outermost tubular conduits adjacent to where the grip foundation starts, the ends of the strength strands are turned radially outward and brought out of the tubular conduit through radial openings in the wall of the tubular conduit. Outside the tubular conduit, the radially extending expanses of the strands are drawn taut and lie essentially in abutting relation to the inner annular end face of each grip foundation (described, but not shown in U.S. Pat. No. 6,426,464). At the circular corner edge between the annular end face of a grip foundation and the circumferential surface of the foundation, the strength strands are turned over the corner and extend axially outward in a groove as described in connection with FIG. 6 herein. These axially extending expanses are interlaced in the opens spaces of the open-mesh-sleeve, and ultimately gathered and bound together and with helically counter-rotating sleeve strands as described in connection with FIGS. 2–5 herein. The advantage to confining the strength strands within the tubular conduits and bringing them out of the conduit in taut abutting relationship to the annular end face and the tautly turning them for interlacing in the longitudinal direction and attachment to the open-mesh-sleeve is that rips and tears in the soft microballoon containing material in annular spaces adjoining the end faces of the grip foundation under stressing and straining of the strength strands is avoided. Similarly, the advantage of passing the strength strands through the tubular conduits and moldingly potting them within the harder encapsulate of the electronic units between the coaxial cable sections is that tears and rips in the softer buoyant microballoon material in annular spaces between the electronic units under stressing and straining of the strength strands is avoided. For additional detail and information see column 12, line 65 through column 18, line 4, of the hereinabove referenced and incorporated by referenced U.S. Pat. No. 6,426,464.

It is to be understood that the form which the object of cable, span assembly 10's support takes has little bearing on broader aspects of the invention. Instead it is to be appreciated that cable span assembly 10 can provide tensile and flexional strength support for any flexible linearly extending utilization object.

Obviously, many other modification and variations of the present invention may become apparent in light of the above teaching. It is therefore to understood that within the scope of the following claims, the invention may be practiced otherwise than as specifically described.

What is claimed is:

1. An interim manufacturing step subassembly of a longitudinal section of a flexible cable comprising:

a core structure having a longitudinal axis and provided at its opposite end portions with cylindrical grip foundation surfaces concentric with said axis;

a one and another grip assemblies at corresponding one and another opposite ends of said core structure, each grip assemblies being of the type having at its axially inwardly disposed end a Chinese-finger-toy-type cylindrical open-mesh-sleeve concentric with said longitudinal axis, the open-mesh-sleeve of the respective grip assemblies being fitted over the cylindrical outer surfaces of grip foundations at the corresponding ends of the core structure;

a set of at least three strength strands to restrain the open-mesh-sleeves of said one and another grip assemblies to positions having a predetermined maximum distance of longitudinal separation, said set of strength strands being equiangular radially spaced in planes perpendicular to the longitudinal axis;

the opposite ends of strength strands of said set being made fast to the associated open-mesh-sleeve;

the construction and arrangement by which the strength strands are made fast to the associated open-mesh-sleeves being such that the span of each strength strand between the open-mesh-sleeve of the one and other grip assemblies is taut;

each strength strand of said set having a linear portion thereof proximate each of its ends which is interlaced in a longitudinal direction through a plurality of successive ones of an axially outward series of open spaces of the associated open-mesh-sleeve; and the marginal end portion at said each of the ends of said each strand is tied to the associated open-mesh-sleeve.

2. The subassembly of claim 1, further comprising:

each cylindrical outer surface of grip foundation having formed therein a corresponding set of longitudinally extending grooves under the paths of the corresponding interlacings of the strength strands through the open spaces of open-mesh-sleeves to accommodate passing of the strength strands under mesh strands as part of said interlacings.

3. The subassembly of claim 1, further comprising:

each said open-mesh-sleeve comprising first and second pluralities of mesh strands which are respectively helically wound in opposite helical directions of rotation and which are interwoven at crossings of the two mesh strand respectively being wound in opposite helical directions of rotation;

the marginal end portions of individual strands of said set at one end of the set and the marginal end portions of the individual strands of the said set at the other end of the set forming respective bundles of strength strand marginal end portions; and each respective bundle of marginal end portions forming a knot which entwines and binds together the bundle and two mesh strands respectively being wound in opposite helical directions of rotation of mesh strands of the open-mesh-sleeve.

4. The subassembly of claim 3, wherein:

each said knot which entwines and binds said bundle and the strands includes excess tail ends of strength strands; and said excess tail ends are tucked under at least one mesh strand with the tucking arrangement infused with hardened glue.

5. The assembly of claim 1, further comprising:

each Chinese-finger-toy-type open-mesh-sleeve responding to attempted sliding withdrawal of the grip foundation surface from the open-mesh-sleeve by radially constricting to increase the griping force exerted upon the associated grip foundation surface.

6. The assembly of claim 1, wherein:

the open-mesh-sleeves of the pair of grip assemblies are made of a metal material; and the strength strands are made of a non-metallic material.

7. The subsystem of claim 6, wherein:

said non-metallic strength strands are made of aromatic polyamide fibers.

8. The subassembly of claim 1, further comprising:

said core structure including a linearly extending energy transmission medium selected from the group of mediums consisting of electric wires, microwave co-axial lines, and fiber optic lines.

9. A method for fabricating a cable section assembly comprising:

providing a core structure having a longitudinal axis and having an axially extending grip foundation surface at it opposite ends;

providing a pair of grip assemblies, each grip assembly at the said end which faces axially inwardly having a Chinese-finger-toy-type open-mesh-cylindrical-sleeve having a predetermined diameter chosen to fit onto a grip foundation surface of the core structure;

fitting respective open-mesh-sleeves of said pair of grip assemblies onto grip foundation surfaces at one and the other of the opposite ends of said core structure; and connecting said respective open-mesh-sleeves by a set of at least three strength strands to restrain the pair of grip assemblies to positions having a predetermined maximum distance of longitudinal separation, said set of strength strands being equiangularly spaced in planes perpendicular to the longitudinal axis;

at each end portion of each strength strand of said set longitudinally interlacing a linear portion of the strand proximate to the end of the strand through a plurality of successive ones of an axially outwardly series of open spaces of the associated open-mesh-sleeves; and at said each end portion of the end of each strength strand tying the marginal end portion thereat to the associated open-mesh-sleeve.

10. The method of claim 9 further comprising:

prior to said connecting of the open-mesh-sleeves causing a longitudinal stress across the individual strength strands in said set; and while the individual strands of the set have tensile strength there across making fast each end of each strength strand to the associated open-mesh-sleeve to form the connection between said respective open-mesh-sleeves by said set of strength strands while individually in taut condition.

11. The method of claim 9, further comprising:

prior to interlacing the linear portions of the strength strands through the open spaces in the open-mesh-sleeve, forming a corresponding set of longitudinally extending grooves in the grip foundation surfaces under the paths of the corresponding interlacings of the strength strands to accommodate passing of the strength strands under mesh strands.

12. A method for fabricating a cable section assembly comprising:

providing a core structure having a longitudinal axis and having an axially extending grip foundation surface at it opposite ends;

providing a pair of grip assemblies, each grip assembly at the said end which faces axially inwardly having a Chinese-finger-toy-type open-mesh-cylindrical-sleeve having a predetermined diameter chosen to fit onto a grip foundation surface of the core structure;

fitting respective open-mesh-sleeves of said pair of grip assemblies onto grip foundation surfaces at one and the other of the opposite ends of said core structure;

connecting said respective open-mesh-sleeves by a set of at least three strength strands to restrain the-pair of grip assemblies to positions having a predetermined maximum distance of longitudinal separation, said set of strength strands being equiangularly spaced in planes perpendicular to the longitudinal axis;

said provided pair of grips assemblies being of the type wherein their open-mesh-sleeves comprise first and second pluralities of mesh strands which are respectively helically wound in opposite directions of rotation and which are interwoven at crossings of counter-rotating mesh strands;

at each end portion of each strength strand of said set forming the marginal end portions of the individual strands into a bundle of strands; and at the respective ends of the set of strength strands forming a knot entwining and binding together the respective bundles of strength strands and two mesh strands of the respective open-mesh-sleeves which are being wound in opposite helical directions of rotation.

13. A microwave coaxial line section cable assembly of a type having a damage resistant outer sheath with the line further embedded in a filler of emollient liquid contained by the sheath comprising:

a longitudinal section of a microwave coaxial line, said coaxial line being of a type having an outer cylindrical surface;

a pair of annular grip foundation collars formed on, and in moldingly bonded relation to, marginal end portions of the microwave coaxial line at opposite ends of the line;

a one and another cable end grip assemblies at corresponding one and another opposite ends of said section of microwave coaxial line, each grip assembly of said one and another being of the type having at its end which faces axially inwardly toward the section of the microwave coaxial line a Chinese-finger-toy-type cylindrical open-mesh-sleeve, the open-mesh-sleeves of the respective grip assemblies being fitted over the cylindrical outer surfaces of grip foundation collars at the corresponding ends of the coaxial line;

a set of at least three strength strands which are equiangularly radially spaced in planes perpendicular to the coaxial line, the strength strands of the set extending through the longitudinally extending annular space between the grip foundation collars, each end of each strand of the set being made fast to the open-mesh sleeve to which it is adjacent; and a cylindrical damage resistant outer sheath concentric with said microwave coaxial line;

the provision of an emollient liquid in said longitudinally extending annular space between the grip foundation collar through which the set of strength strands extend; and said outer sheath having a midsection coextensive with and around the portion of the coaxial line intermediate the grip foundation collars, and adjoining the opposite ends of the midsection having marginal end portions which extend axially outwardly the arrangement of said sets of strength strands made fast to the open-mesh-sleeves, which marginal end portions are attached to said cable-end grip assemblies with an emollient liquid sealing relationship thereto.

14. The cable assembly of claim 13, further comprising:

said outer layer of the microwave coaxial cable line being made of a material which moldingly bonds with polymer;

said pair of annular grip foundation collars are moldingly bonded to said outer layer portion of said coaxial cable line; and said grip foundation collars being made of a polymer at the group consisting of polyurethane polysulfide, and RTV silicone.

15. The cable assembly of claim 13, further comprising:

each strength strands of said set of at least three strength strands being made of aromatic polyamide fibers.

* * * * *